United States Patent [19]

Hanna

[11] Patent Number: 4,910,637

[45] **Date of Patent: * Mar. 20, 1990**

[54] MODIFYING THE DISCHARGE BREAKDOWN

[76] Inventor: Rinoud Hanna, 4058 W. Henrietta Rd., Rochester, N.Y. 14623

[ * ] Notice: The portion of the term of this patent subsequent to Jun. 20, 2005 has been disclaimed.

[21] Appl. No.: 944,570

[22] Filed: Oct. 23, 1978

[51] Int. Cl.[4] ..... H06F 3/04

[52] U.S. Cl. ..... 361/229; 361/230

[58] Field of Search ..... 361/229, 230, 213, 220, 361/222; 250/324–326

[56] References Cited

U.S. PATENT DOCUMENTS

| | | | |
|---|---|---|---|
| 3,471,695 | 10/1969 | Hudson et al. | 361/230 |
| 3,483,372 | 12/1969 | Benson | 361/230 X |
| 3,566,108 | 2/1971 | Weigl et al. | 361/230 X |
| 3,723,111 | 3/1973 | Kojima et al. | 361/229 X |
| 3,742,237 | 6/1973 | Parker | 361/230 X |
| 3,742,301 | 6/1973 | Burris | 361/230 |
| 3,764,866 | 10/1973 | Bonaventura et al. | 361/230 |
| 3,783,283 | 1/1974 | Smith, Jr. | 250/325 X |
| 3,789,278 | 1/1974 | Bingham et al. | 361/230 X |
| 3,794,839 | 2/1974 | Hayne | 250/324 |
| 3,813,549 | 5/1974 | DiStefano et al. | 361/230 X |
| 3,983,393 | 9/1976 | Thettu et al. | 361/230 X |
| 4,086,650 | 4/1978 | Davis et al. | 361/230 X |
| 4,099,219 | 7/1978 | Laing | 361/230 |

*Primary Examiner*—Michael L. Gellner

[57] ABSTRACT

A corona discharge device having a modified barrier which improves the discharge properties, is described. The device includes a metal electrode, a low field conductive plane and an ac or dc voltage source for applying a potential to the electrode. The barrier is positioned between the electrode and the plane and, in various embodiments, is in contact with either the electrode or the plane or neither one. The barrier is comprised of any of several materials including a doped glass or ceramic, a porous glass or ceramic, a dispersion of metal with glass or ceramic, a semiconductor, a photoconductor or a fibrous material which functions as a catalyst substrate.

18 Claims, 1 Drawing Sheet

MODIFYING THE DISCHARGE BREAKDOWN

BACKGROUND OF THE INVENTION

1. Field of the Invention

This invention relates to a corona discharge device having a modified barrier. More particularly, it pertains to barrier structures and arrangements which improve the discharge characteristics of corona devices which are commonly used in xerographic reproduction systems.

2. Description of the Prior Art

The use of corona discharge devices is well known in the art. Moreover, the use of dielectric shields or barriers to help control corona discharges are also known. Notwithstanding these developments, difficulties still remain concerning charge uniformity, the formation of ozone which causes undesirable chemical reactions and the control of stray currents and unwanted leakage. Some of the standard prior art textural references which contain discussion of the technical aspects of corona devices are set forth below:

(1) Loeb, L., "Electrical Coronas," University of California Press (1965)

(2) Glockler, G. and Lind, S. C., "The Electrochemistry Of Gases And Other Dielectrics," John Wiley & Sons, Inc., (1959)

(3) Kittel, C., "Introduction to Solid State Physics," John Wiley & Sons, Inc. (1959)

(4) Azaroff, L. V. and Brophy, J. J., "Electronic Processes In Materials," McGraw-Hill Book Co. Incl (1963).

SUMMARY OF THE INVENTION

In accordance with the present invention, a modified barrier is used as an integral part of a corona discharge device. The structure and arrangement of the barrier improve the discharge characteristics of the corona. The discharge device typically includes a metal electrode and a low field conductive plane which is spaced apart from the metal electrode so as to form a space gap between the electrode and the plane. The device also includes an ac or dc voltage source for applying a potential to the electrode. The barrier used in conjunction with the device is positioned between the electrode and the plane. In one embodiment it contacts the electrode, in another embodiment it contacts the plane and in yet another embodiment it is situated in the space gap and does not contact either the plane or the electrode. The barrier is either (a) a doped material such as a glass or ceramic material which is doped with a transition metal or a rare earth element, (b) a porous glass or ceramic, (c) a dispersion of a metal in ceramic (ceramet), glass in metal or glass in ceramic, (d) a semi conductor or a photoconductor or (e) a fibrous material which functions as a catalyst substrate. Particularly beneficial results occur when the barrier is grounded.

BRIEF DESCRIPTION OF THE DRAWINGS

FIG. 2-II is a cross sectional view which is similar to FIG. 2-I except the barrier 3 (left) is located in close proximity to the anode 1 whereas barrier 3 (right) is located in close proximity to the plane 2.

FIG. 2-III is a cross sectional view which shows the barrier 3 (left) in contact with anode 1 whereas barrier 3 (right) is in contact with plane 2.

DETAILED DESCRIPTION OF PREFERRED EMBODIMENTS

Figure 1:
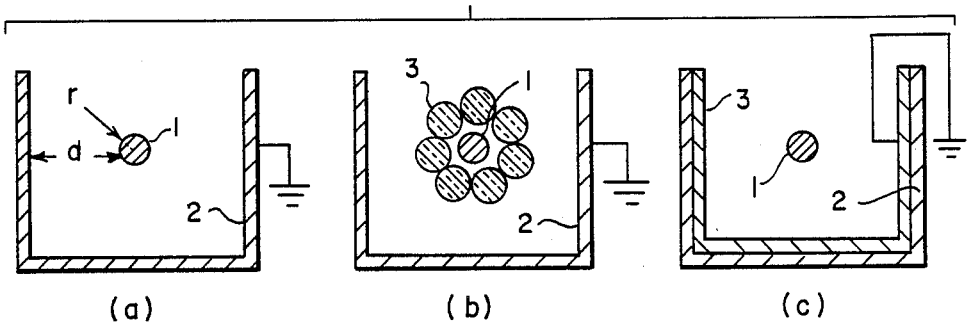
FIG. 1*a* is a cross sectional view of a corona discharge device showing a wire electrode 1 and low field conductive plane 2.
FIG. 1*b* is a cross sectional view which is similar to FIG. 1*a* except that it includes a barrier 3 of 7 glass rods.
FIG. 1*c* is a cross sectional view which is similar to FIG. 1*a* except that a barrier 3 of aluminum oxide is deposited on the surface of the plane 2.

The invention is based on effecting the discharge of a corona device by inserting an insulating barrier between the metal electrodes of a point to plane which, in effect, converts the discharge unit into an "all-glass" or "semi-corona" ozonizer. However, the original function of the discharge unit remains the same i.e. to electrostatically charge a photoconductor by a corona. The same concept is applicable to other gap forms of discharges.

The barrier of this invention has the following functions:

(1) it interferes with space charge clouds formation and movement;

(2) it causes secondary emission by electrons or photons as well as electron reflection;

(3) it causes attenuation of corona photons by absorption;

(4) it causes heterogenous combination, dissociation, etc. between the various ionic species;

(5) it decreases the effective gap length; and (6) it serves as a sink for excess kinetic energy.

The function of the barrier depends on several factors. The main factors are the barrier nature and its position in the gap. While the invention involves may possible variations, two cases have been selected for detailed description. However, it is understood that the data discussed below is not limiting on the scope of the invention. For purposes of enhancing an understanding of the invention, the descriptions pertain to (1) a thick, discontinuous glass barrier near the electrode of the high field and (2) a thin, continuous n-type semiconductor barrier in contact with the electrode of the low field.

The discharge unit shown in FIG. 1*a* consists of a thin platinum wire 1, having a radius, r of 0.05 mm and a length of 36 cm. as the highly stressed point. The low field conductive plane is a U-shaped aluminum electrode 2. The latter serves as a current collector, and when it is the cathode, dominates the breakdown through its furnishing the secondary mechanism ($\gamma$). The gap length, d is 1 cm.

The unit of FIG. 1*b* is similar to the unit shown in FIG. 1*a* but includes an insulator barrier 3 that consists of 7 pyrex glass rods, each having a radius of 1.5 mm. and a length which is the same as that of wire 1. The rods encircle the wire longitudinally.

The unit of FIG. 1*c* is also similar to that of FIG. 1*a* except the low field plane electrode 2 is anodized electrochemically in sulfuric acid to provide an oxide barrier layer on the surface of the aluminum. The aluminum oxide dielectric layer becomes a "semi-corona" ozonizer when the device is discharged.

The three units are operated in air having flow rate of 1000 cc/min, using dc (positive and negative) and ac potentials. The current levels selected to operate each of the units are 60 microamps for dc positive, 10 microamps for dc negative and 50 microamps for ac. The results are shown in Table I. The unit of FIG. 1*a* demonstrates a steady current in the positive dc and ac modes. However, it does not do so for the negative dc potential. For the point anode, the steady Hermstein negative ion-created corona discharge is fcilitated by any secondary electron emission from the cathode. In the negative dc potential, the positive ions are drawn to the cathode. They bombard its surface and remove its thin oxide layer. This, in turn, augments $\gamma_p$ which starts the breakdown by adding an effective $\gamma_i$ to the secondary liberation. As current increases with increased potential, the regular pulses give way to irregular pulses and corona spots go off and on, making pulses incoherent and resulting in current fluctuations. In the unit of FIG. 1*b*, the current is set at 60 microamps in positive dc. However, it is necessary to continuously increase the applied field by approximately 1000 volts to maintain the same current level. In the negative mode, the current is unsteady and after about 12 minutes, the breakdown terminates. This is attributed to the rapid accumulation of negative ions just outside the positive space charge.

In the unit of FIG. 1*c* the current in both positive and negative dc potentials becomes steady after an initial period of fluctuations and sparks. The unit is grounded via the dielectric barrier 3 instead of via the underlying aluminum metal. In the positive dc, the 60 microamp current is essentially constant at 4985 V for about 14 minutes but there is a sudden spark. When the voltage is reduced to 4600 V, the current remains steady at 20 microamps for 30 minutes. When the current is increased beyond 30 microamps (4700 V), the spark returns. When the voltage is decreased again to 4600 V, the current fluctuates between 32 and 45 microamps for 5 minutes, giving 6.6 ppm $O_3$. The current reaches 20 microamps and becomes steady for at least 45 minutes, producing the lowest ozone concentration (1.0 ppm). In the negative dc, the current is steady at 10 microamps. Likewise, the current in the ac potential is steady at 50 microamps. When the potential is 4500 and 3500 V, the ozone concentration is 2.4 and 3.8 ppm respectively.

TABLE I

| Unit | Mode | Time (min) | Potential (V) | Current (μA) Set | Current (μA) Actual | $O_3$ ppm | Current Observations |
|---|---|---|---|---|---|---|---|
| FIG. 1a | (+) dc | 0 | 4860 | 60 | 60 | — | |
| | | 1 | | | | 1.5 | |
| | | 2 | | | | 2.6 | |
| | | 4 | 4870 | 60 | 60 | 3.6 | |
| | | 7 | | | | 4.2 | |
| | | 10 | (steady) | | | 4.2 | |
| | | 16 | | | | 4.6 | |
| | (−)dc | 0 | 4000 | | — | — | fluctuates |
| | | 2 | 4300 | 10 | 5 | 1.4 | decreases |
| | | 7 | 4400 | 10 | 7.5 | 4.2 | fluctuates |
| | | 8 | 4500 | 10 | 10 | 5.0 | fluctuates |
| | ac | 0 | 3400 | 50 | 54 | — | |
| | | 2 | 3400 | 50 | 53 | 1.2 | |
| | | 15 | 3400 | 50 | 54 | 4.2 | |
| FIG. 1b | (+)dc | 0 | 8900 | | — | — | |
| | | 3 | 9300 | 60 | 60 | 0.4 | |
| | | 5 | 9850 | 60 | 60 | 1.0 | declines continuously |
| | | 8 | | 60 | 57 | 1.7 | |
| | | 14 | 9999 | 60 | 92 | 2.4 | |
| | (−)dc | 1 | 8679 | 10 | 5 | 4.4 | fluctuates |
| | | 3 | 9550 | 10 | 10 | 5.4 | |
| | | 12 | | | | 0 | dropped to 0. breakdown terminated |
| | ac | 0 | 3500 | 50 | 50 | — | |
| | | 1 | | | | 1.8 | |
| | | 3 | (steady) | | | 3.2 | |
| | | 9 | | | | 3.2 | |
| | | 17 | | | | 3.8 | |
| FIG. 1c with Al ground | (+)dc | 0 | 4800 | 60 | 60 | — | violent increase spark |
| | | 2 | 4800 | 60 | 50 | 3.6 | unstable |
| | | 4 | 4830 | 60 | 50 | 4.2 | |
| | | 6 | 4899 | 60 | 60 | 5.6 | |
| | | 8 | 4900 | 60 | 63 | 6.0 | |
| | | 13 | 4899 | 60 | 60 | 7.0 | |
| | (−)dc | 0 | 4300 | 10 | 10 | — | |
| | | 1 | | | | 1.8 | fluctuates |
| | | 4 | | | | 3.7 | fluctuates |
| | | 7 | 4500 | | | 4.0 | decreases then steady |
| | | 13 | | 10 | 6 | 2.5 | |
| | | 15 | 4650 | 10 | 10 | 4.5 | |
| | | 19 | 4650 | 10 | 9 | 4.5 | |
| | ac | 0 | 3500 | 50 | 50 | — | |
| | | 2 | | | | 1.6 | |
| | | 4 | | | | 2.0 | |
| | | 11 | (steady) | | | 2.2 | |
| | | 23 | | | | 2.4 | |

For ac potentials, the presence of barriers do not have an apparent effect on the discharge stability or the potential and current relationship. However, the chemical reactions caused by the discharge, as manifested by the ozone formation, are different. When a dc potential is applied, large changes in the corona discharge occur as a result of inserting the barrier in the gap. In the unit of FIG. 1*c*, a thin continuous barrier in contact with the aluminum plane requires about the same potential to obtain a given current value as in the unit of FIG. 1*a*. On the other hand, the FIG. 1*b* unit requires much higher potentials due to the large thickness of the glass barrier surrounding the wire notwithstanding the discontinuous structure of the barrier. There are differences in the currents of the dc potentials. In some cases a continuous decline in current is noted because of the space charge (FIG. 1*b*). In other cases current instability, ranging from small oscillations to a spark, is noted. The latter is summarized in Table II:

TABLE II

| Potential | Current FIG. 1 a Unit | Current FIG. 1 b Unit | Current FIG. 1 c Unit Ground Plane | Current FIG. 1 c Unit Ground Barrier |
|---|---|---|---|---|
| (+)dc | steady | unstable | unstable steady | steady |
| (−)dc | unstable | unstable | unstable steady | steady |

As mentioned above, the current of the FIG. 1*b* unit in the positive dc declines continuously from 60 microamps. This is due to the accumulation of the positive space charge between the wire and the barrier. Since the positive ions collect when the wire is the cathode, it takes some time to reach the critical point. The barrier delays the movement of these positive ions to the cathode plane. At the beginning of the negative dc run, the use of higher amplifications are not successful for reaching the 10 microamps current level. The negative charge cloud builds up very quickly because it is hindered from moving to the plane. Such space charge inhibits further emission of other electrons from the cathode because of the electrostatic repulsion (cf. Thermionic emission). The FIG. 1*c* unit shows an initial period of stability in both modes of the dc which is followed by stable behavior.

Based on the foregoing, the following significant results are noted: (1) the barrier stabilizes the discharge current in the negative dc potential which is not possible when no barrier is used (FIG. 1*a*); and (2) grounding the discharge unit via the barrier (FIG. 1*c*) eliminates the initial unstable period thereby making the unit stable in both dc positive and negative. The current in the positive mode is only 20 microamps in comparison to the 60 microamps of the FIG. 1*a* unit. Thus, grounding via the barrier is a new and important feature which gives improved and different discharges. Apparently, the mechanism involves the lateral sweep of the charges without having to transverse the barrier. The low field metal electrode may be eliminated altogether, or may be used merely as a mechanical support for the barrier.

The effect of the barrier on the discharge characteristics depends on the following considerations:

(1) whether the barrier is continuous, e.g. glass or other dielectric tubing, or is discontinuous, e.g. a perforated or grid-like structure, glass spheres, and fiberglass which increases the surface to volume ratio for heterogeneous reactions;

(2) the wall thickness of the barrier;

(3) the use of more than one barrier made from the same or different materials;

(4) the position in the gap, ranging from x=0 to x=d, where x is the distance from a point on the surface of the wire to the surface of the barrier and d is the distance from a point on the surface of the wire to the surface of the conducting plane; and (5) the chemical and physical properties of the barrier.

Figure 2:
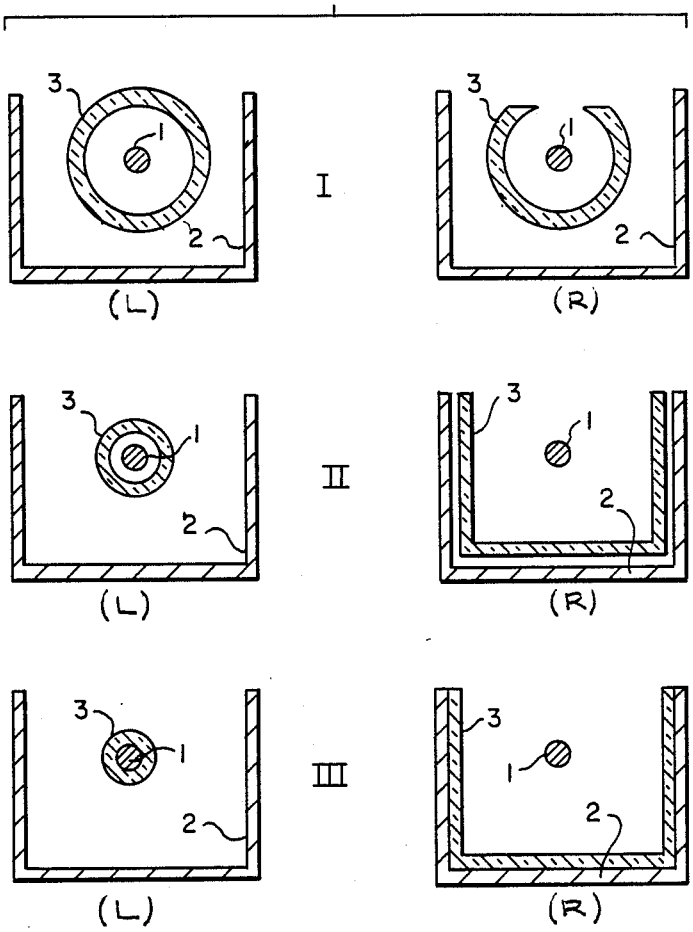
FIG. 2-I is a cross sectional view of a corona discharge device wherein closed and open barriers 3 are situated in the middle of the space gap between electrode 1 and plane 2.

With regard to barrier effect (4) above, as shown in FIGS. 2-I, 2-II and 2-III, the various barrier positions are grouped as follows;

Position I is in the middle of the gap, far from the ionization regions of both electrodes. The field is increased by the positive ions, which lead to an unstable condition. The barrier itself may catalyze a certain reaction or act as a substrate for a catalyst.

Position II is in the vicinity of either electrode. When near the highly stressed electrode, a corona develops on the barrier itself. When near the cathode plane, the arrival of the streamer photons and ions trigger electrons from the barrier and cathode, and photoionize the gas between them. Two barriers may be deployed simultaneously.

Position III is in actual contact with either electrode whereby the discharge unit is transformed into "semi-corona" ozonizer. When both electrodes are covered with the barrier, the unit is then an "all-glass" ozonizer, which is considered as a system of three condensers (glass/gas/glass) placed in series.

The screening of the metal electrode by a thin barrier may not be strictly true on a microscopic scale. Anodic oxidation of cadmium, for example, results in the presence of free metal surface. This may be due to crystal growth which takes place only at certain nuclei on the surface. It may also be caused by random initial nucleation accompanied by Ostwald ripening.

Placing the barrier in contact with the metal electrode is either accomplished by (a) coating the electrode with a different substance or phase, as in enamelling or by (b) forming a barrier which is related to the substratum, by controlled thermal oxidation or electrochemical methods. Epitaxial relationship may then exist between the metal and its oxide. Surface smoothing and sintering below or at the Tammann temperature reduces the area of the film barrier by diffusion of vacancies and interstitials. Thus, as in the case of glass with its numerous variations, it is possible to prepare a vast number of metal oxide, as well as non-oxide barriers.

The presence of the barrier on the metal electrode changes the electron emission since $\gamma_i$ depends on the surface conditions, where $\gamma_i$ is the action of ions of first avalanche on the cathode. The starting potential of the Trichel pulse depends on the secondary emission. The surface energy barrier is inversely proportional to the interatomic spacing of the metal. The electron emission of polycrystalline metal with its random crystallographic planes is therefore, not homogeneous, in contrast to glass. A low-order pre-pulse breakdown may occur in the discharge unit. This leads to weak discharge currents that alter the metallic point.

In a large electric field, the work function of the metal is reduced by the Schottky effect and the potential energy barrier becomes thinner. It is also possible to induce field emission into an insulator, e.g. $Al_2O_3$, through quantum-mechanical tunnelling. Specks of insulator such as MgO, $Al_2O_3$ and $SiO_2$ are used to produce regular triggering and pulses in filtered clean air. The dust particles become charged by the positive ions of the first pulse. The field across this thin layer of insulator becomes so high that it gives rise to electrons (Malter effect).

The secondary yeild, $\delta$, for MgO is higher than Pt or Au, because the electrons, to be emitted, interact with the ions in the crystals more strongly than the free metal electrons, and thus $\delta$ is greater. The photo-efficiency of metal surface is lower than that of semiconductor surface due to its high reflectivity and the free electron cloud.

In position III the metal surface is protected from sputtering and does not need "conditioning". It also allows the use of a less expensive metal which otherwise is attacked by the reaction components, e.g. ozone. It also avoids the formation of chemical compounds, e.g. As, Sb and Bi in hydrogen.

With regard to barrier effect (5) above, the conductivity of the barrier plays a very important role in its interaction with the discharge. Displacement of ionic charges occurs in the electric field and the current carriers are the Frenkel and Schottky defects. In semiconductors, the electric breakdown in the high electric field is by Zener breakdown. In the unit of FIG. 1*c*, the breakdown in the alumina barrier is probably by avalanche formation. The current flowing across the metal and the glass or ceramic barrier causes heat generation (the Peltier effect). This not only increases the conductivity of the barrier, but it also gives regular pulses due to the increase in the electron emission due to the heat.

Sintered glass, leached glass or a ceramic barrier with unsealed pores, enhances the electric breakdown. The breakdown is also effected in the insulator by the presence of polarizable atoms or permanent dipoles. Similarly, doping with atoms such as transition metals or rare earth elements effects breakdown. Electrons injected from the point into the glass barrier are available for conduction. When their energies become sufficiently great, they collide with other electrons producing avalanche of electrons and holes. Moreover, the total void space of a glass may be as much as 30%. Thus, the occluded gas bubbles ionize and the gas ions bombard the internal glass surfaces until electric breakdown occurs. The conductivity in alkali glasses is by the drift of alkali ions through the "holes" in the glass network. The conductivity may proceed in other glasses via the drift of non-bridging oxygen ions migrating from network site to network-modifying site. Some glasses, however, exhibit electronic conductivity, e.g. chalcogenides. It is hence, possible to produce a wide variety of barriers with controlled electrical (dielectric) properties. Therefore, for a given metal electrodes configuration, different types of discharge units or glow-discharge reaction vessels could be constructed.

The invention has been described in detail with reference to preferred embodiments thereof. However, it will be understood that variations and modifications can be effected within the spirit and scope of the invention.

I claim:

1. A corona discharge device comprising:

a. a metal electrode, b. a low field conductive plane which is spaced apart from said electrode so as to form a space gap between said electrode and said plane, c. means to apply dc or ac voltage to said electrode, and d. a doped barrier which is situated between the electrode and plane, said doped barrier comprising a glass or ceramic material which is doped with a transition metal or a rare earth element.

2. The device of claim 1 wherein the barrier contacts the electrode.

3. The device of claim 1 wherein the barrier contacts the plane.

4. The device of claim 3 wherein the barrier is grounded.

5. The device of claim 1 wherein the barrier is situated in the space gap between the electrode and the plane and does not contact either the electrode or the plane.

6. A corona discharge device comprising:

a. a metal electrode, b. a low field conductive plane which is spaced apart from said electrode so as to form a space gap between said electrode and said plane, c. means to apply dc or ac voltage to said electrode, and d. a porous glass or ceramic barrier which is situated between the electrode and the plane, said porous glass or ceramic barrier having up to 30% void space.

7. The device of claim 6 wherein the barrier contacts the electrode.

8. The device of claim 6 wherein the barrier contacts the plane.

9. The device of claim 8 wherein the barrier is grounded.

10. The device of claim 6 wherein the barrier is situated in the space gap between the electrode and the plane and does not contact either the electrode or the plane.

11. A corona discharge device comprising:

a. a metal electrode, b. a low field conductive plane which is spaced apart from said electrode so as to form a space gap between said electrode and said plane, c. means to apply dc or ac voltage to said electrode, and d. a barrier comprising a dispersion selected from the group consisting of a metal in a ceramic (ceramet), glass in a metal and glass in a ceramic, said barrier being situated between the electrode and the plane.

12. The device of claim 11 wherein the barrier contacts the electrode.

13. The device of claim 11 wherein the barrier contacts the plane.

14. The device of claim 13 wherein the barrier is grounded.

15. The device of claim 11 wherein the barrier is situated in the space gap between the electrode and the plane and does not contact either the electrode or the plane.

16. A corona discharge device comprising:

a. a metal electrode b. a low field conductive plane which is spaced apart from said electrode so as to form a space gap between said electrode and said plane, c. means to apply dc or ac voltage to said electrode, d. a barrier comprising a solid material which is situated between the electrode and the plane and which contacts the plane and e. means to ground the barrier.

17. The device of claim 16 wherein the barrier is a semiconductor or a photoconductor.

18. The device of claim 16 wherein the barrier is a fibrous material which is suitable as a catalyst substrate.

* * * * *